United States Patent [19]

Krull

[11] 3,933,340

[45] Jan. 20, 1976

[54] METHOD OF AND APPARATUS FOR DRY MIXING

[76] Inventor: Frank B. Krull, Highway M-35 Ingallstan, P.O. Box 55, Menominee, Mich. 49858

[22] Filed: Jan. 6, 1975

[21] Appl. No.: 538,883

Related U.S. Application Data

[63] Continuation of Ser. No. 420,657, Nov. 30, 1973.

[52] U.S. Cl. ..... 259/14; 259/147; 259/149; 259/154; 259/165

[51] Int. Cl.[2]... B01F 13/06; B01F 15/04; B01F 15/02

[58] Field of Search ..... 259/14, 147, 149, 154, 259/165, 30, 3, 57, 125, 116, 146, 148, 153, 259/164, 165, 175, 176, 177 R, 177 A

[56] References Cited

UNITED STATES PATENTS

| | | | |
|---|---|---|---|
| 2,494,119 | 1/1950 | Essick | 259/177 R |
| 3,164,378 | 1/1965 | Hager | 259/177 R |
| 3,266,779 | 8/1966 | Fischer | 259/14 |
| 3,279,763 | 10/1966 | Seman | 259/14 |

*Primary Examiner*—Robert W. Jenkins

[57] ABSTRACT

A method and apparatus for mixing fine powdered materials without creating an objectionable dusty environment, which consists in placing an open-topped container on a scale, placing a hood over the open-topped container, and with the hood interior connected to a source of suction, successively pouring the materials to be mixed into the container through a hole in the top of the hood and proportioning the materials by means of the scale. With the container thus filled, its open-topped upper portion is inserted into the downwardly facing mouth of a tiltable mixing drum and secured thereto in such a manner that the container tightly closes the mouth of the mixing drum so that admixture of the drum contents during rotation of the drum can take place without dispersing dust or fine powder into the atmosphere.

8 Claims, 8 Drawing Figures

METHOD OF AND APPARATUS FOR DRY MIXING

This invention like that of my U.S. Pat. No. 3,792,837, relates to dry mixing of different materials, including fine lightweight pulverized material such as very fine aluminum powder, the instant application being a continuation of my allowed application Ser. No. 420,657, filed Nov. 30, 1973.

As explained in my aforesaid patent, the admixture of fine powdered materials could not be carried out, prior to the invention of that patent, without creating an obnoxious and unhealthy dusty environment. The invention of the patent overcame that objection but had the disadvantage of requiring all but the finest powdered material to be charged into the drum of the mixing machine in the conventional way and limited the quantity of material that could be introduced dust-free into the mixing drum.

The present invention makes it possible not only to introduce a considerably larger quantity of material into the mixing drum in a dust-free manner, but provides a convenient way of proportioning the ingredients of the admixture and then introducing the entire batch into the mixing drum without disturbing the material.

The purpose and object of this invention is thus to provide an improved method and apparatus for effecting the admixture of dry powdered and powder-like materials.

With these observations and objectives in mind, the manner in which the invention achieves its purpose will be appreciated from the following description and the accompanying drawings which exemplify the invention, it being understood that changes may be made in the precise method of practicing the invention and in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and a modification of a part of that complete embodiment, in which drawings.

Figure 1:
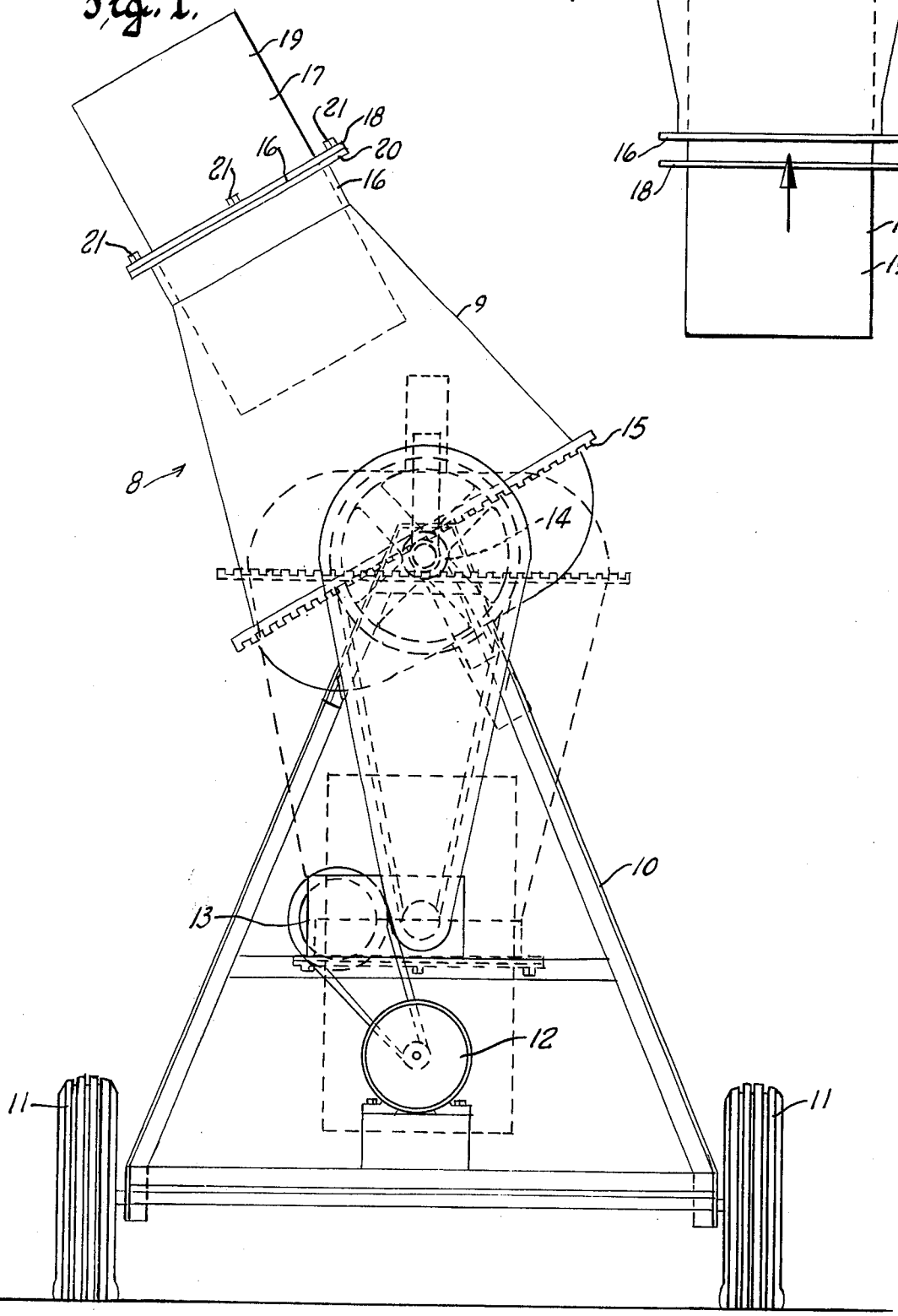
FIG. 1 is a side view of the mixing machine used to admix the materials.

Referring now to the accompanying drawings, and especially to FIG. 1, the numeral 8 designates generally a more or less conventional mixing machine comprising a tub-like drum 9 mounted in the usual manner for rotation about its central axis and for endwise tilting motion in a frame 10 which has wheels 11 to facilitate transporting the machine. A motor 12 provides a power source for imparting rotation to the drum. The motor is drivingly connected with the drum through reduction transmission means 13 which drives a pinion 14 that meshes with a ring gear 15 encircling and fixed to the drum. Another motor (not shown) also acting through appropriate reduction transmission means, is used to tilt the mixing drum between a charging position which — for this invention — has the single charging and discharging mouth 16 of the drum facing downward, as shown in dotted lines in FIG. 1, and a mixing position (shown in full lines in FIG. 1) in which position the mixing blades (not shown) on the interior walls of the drum are most effective.

Figure 2:
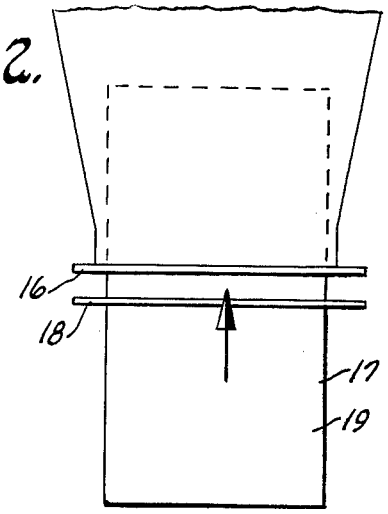
FIG. 2 is a side view of part of the mixing drum and the container of materials to be mixed, showing the same in the act of being assembled.

In accordance with this invention, all of the materials to be admixed are preferably simultaneously charged or deposited into the mixing drum by attaching to its mouth an open-topped container 17 which holds the materials to be mixed. As indicated in FIG. 2, during the charging of the mixing drum, the container is lifted up into the downwardly facing mouth of the mixing drum until a flange 18 fixed to and encircling the side wall 19 of the container abuts a similar flange 20 that encircles the mouth of the mixing drum. The flanges are then releasably secured together by bolts 21, and as a result the container and mixing drum coact to provide a closed chamber in which the materials can be thoroughly admixed without creating an objectionable and hazardously dusty environment.

Figure 7:
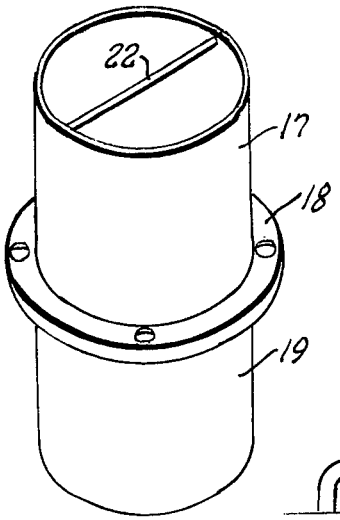
FIG. 7 is a perspective view of the container into which the different materials are loaded preparatory to being mixed.

The sides and bottom of container 17 are of course imperforate, and its upper portion at least is cylindrical and of a size to telescope into the round mouth 16 of the mixing drum. To facilitate carrying the container, a handle-forming bar 22 extends diametrically across its open top, as shown in FIG. 7. The capacity of the container 17 is determined only by the diameter of the mixing drum mouth and the extent that the dimensions of the frame 10 in which the mixing drum is tiltably mounted permit the container to protrude from the mixing drum. Space to accommodate the container 17 during its releasable attachment to the drum 9 (depicted in FIG. 2) can be provided in any suitable way, as for instance by increasing the height of the drum supporting frame 10, or providing a pit in the floor on which the machine stands with its wheels straddling the pit.

Figure 3:
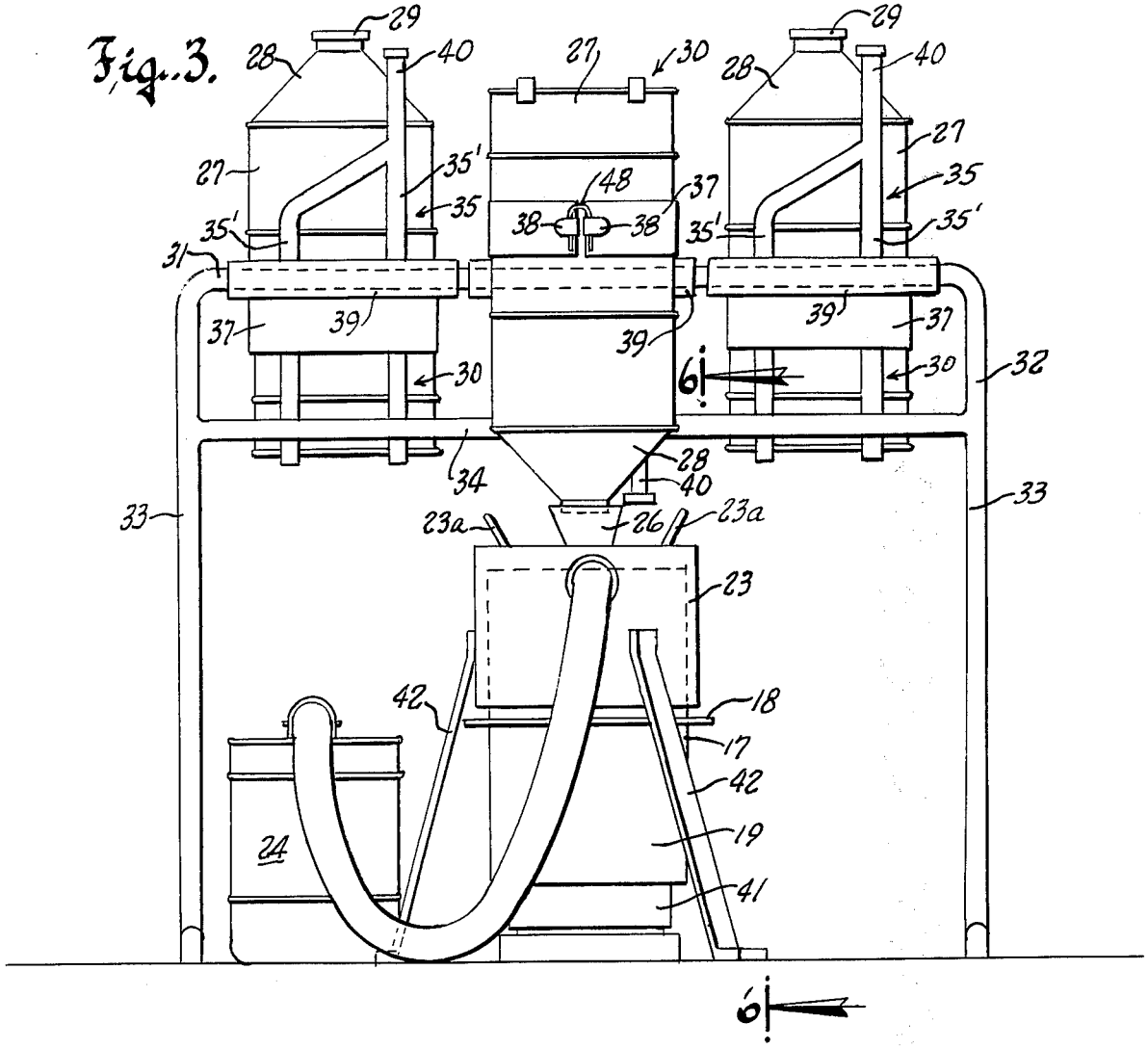
FIG. 3 is a front elevational view of the apparatus with which the different materials are proportioned and combined in a dust-free manner, preparatory to being admixed in the mixing drum.
Figure 6:
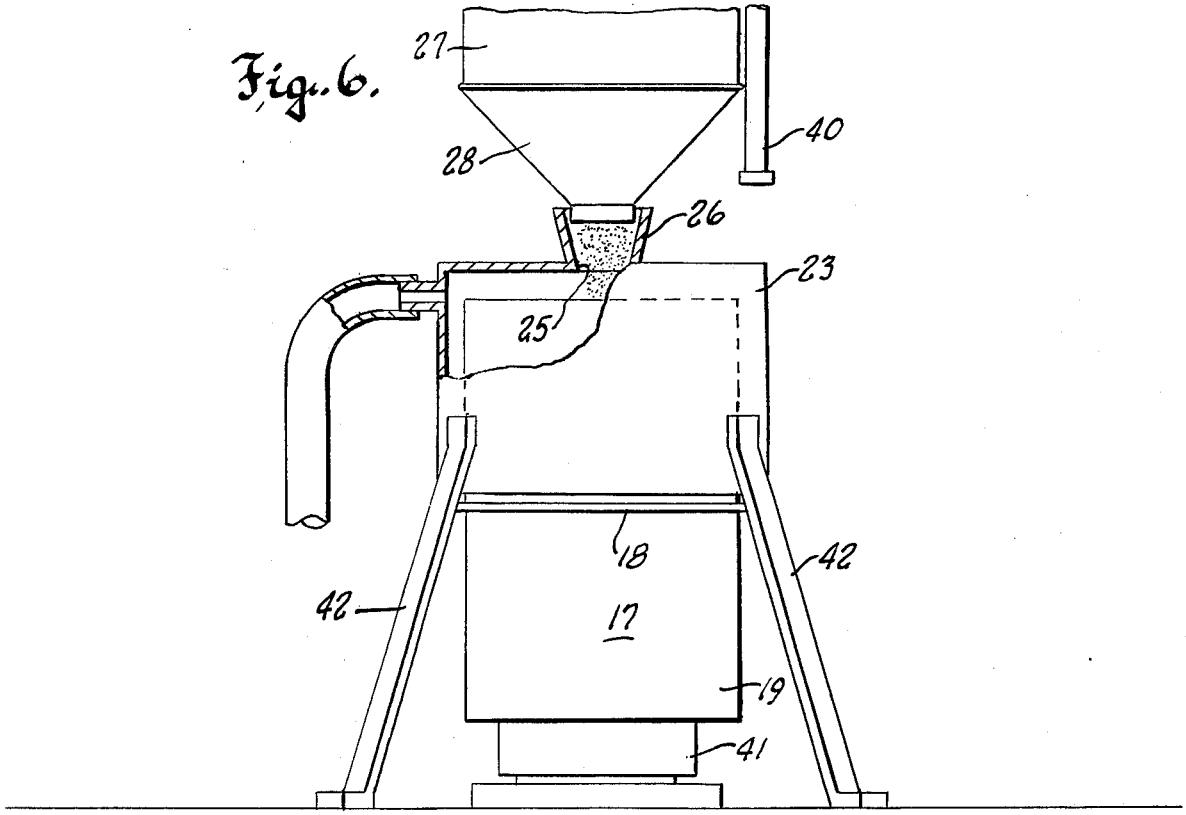
FIG. 6 is a sectional view through FIG. 3 on the plane of the line 6—6.

For the complete operation to be performed without creating a dusty environment, it is necessary that the materials to be mixed be originally introduced into the container 17 in a dust-free manner. This is accomplished by covering the open top of the container, preparatory to charging different materials into it, with a removable hood 23, having carrying handles 23A and three angularly extending support legs 42, as shown in FIGS. 3 and 6, connecting the hood interior with the intake port of a suitable source of suction which may be an industrial vacuum cleaner 24, and then feeding the materials into the container through a hole 25 in the top of the hood. A funnel 26 projecting upwardly from the edge of the hole 25 guides the material into and through the hole 25.

As is well known, the vacuum cleaner 24 has an exhaust port (not shown) and preferably that outlet port has a hose (also not shown) connected to it and leading to the exterior of the building in which the apparatus is located.

Figure 4:
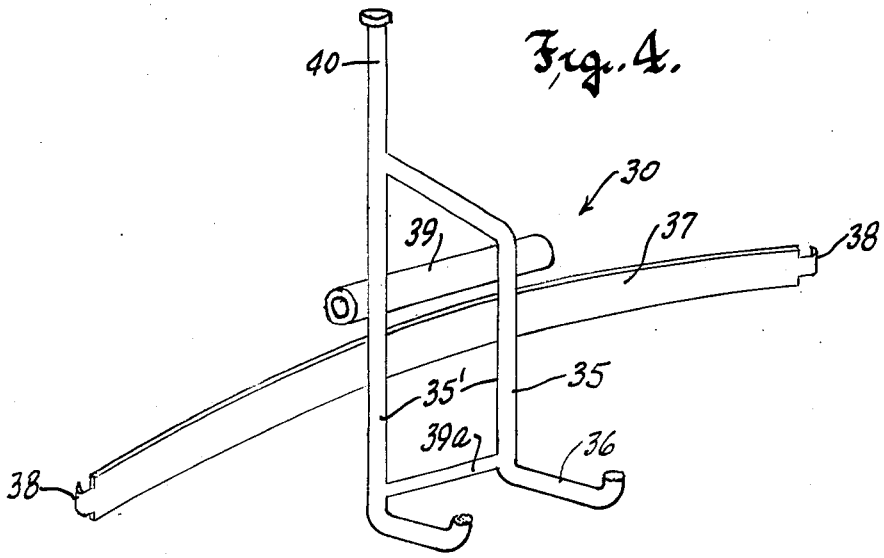
FIG. 4 is a prespective view of one of the parts of the apparatus depicted in FIG. 3.

The materials to be mixed are delivered by the producers thereof in cans or receptacles 27 that have funnel-shaped upper ends 28 leading to the mouth of the can, which is closed by a removable cap 29. To facilitate transfer of the material from the cans or receptacles 27 to the container 17, the cans or receptacles are placed on and secured to individual carriers 30 (FIGS. 3 and 4) that are tiltably mounted on an upper cross bar 31 of a supporting stand 32.

Figure 5:
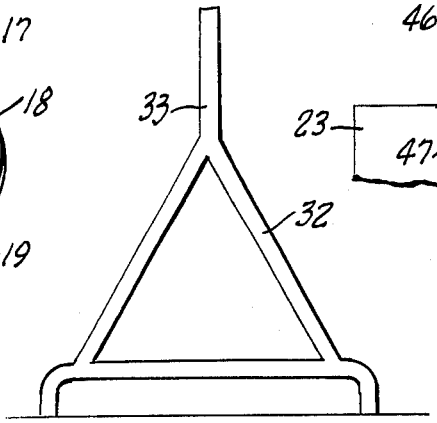
FIG. 5 is a side view of the lower portion of one of a pair of stanchions that form part of a frame that supports the aforesaid apparatus.

The stand 32 comprises a pair of spaced apart vertical uprights 33 connected by the upper cross bar 31 and a lower cross bar 34. As shown in FIG. 5, the spaced apart vertical uprights 33 of the stand 32 form parts of stanchions that have angularly divergent legs. Although the supporting stand 32 can be made of any suitable material, it is shown as having been fabricated from welded-together lengths of tubing. The carriers 30 are similarly fashioned into a sturdy L-shaped structure having a back 35 and a forwardly projecting supporting shelf 36 at its bottom. The back 35 consists of spaced apart vertical tubular members 35' secured together by transverse members 39 and 39A, and the shelf 36 is formed by forwardly projecting end portions of the tubular members 35'.

A strap 37 which may be a band of flexible metal, is fixed to the back 35 as by being welded thereto, intermediate the transverse members 39 and 39A, and provides means for holding a can or receptable 27 on the carrier. For this purpose, the strap is wrapped around the can after it has been set onto the shelf of the carrier, and has its ends separably connected in any acceptable way to securely hold the can or receptacle on the carrier. For illustration, the ends of the band are shown provided with hooks 38 to receive the legs of a U-shaped connector 48, which — upon being engaged with the hooks — holds the ends of the band together.

The carriers 30 are tiltably mounted on the stand by having their transverse members 39, which are tubular and of sufficient diameter for the purpose, slipped onto the upper cross bar 31 before one of its ends is joined to its respective upright 33. An integrally formed handle 40 projecting upwardly from the back 35 of each carrier, facilitates tilting the carriers and the cans or receptacles thereon from an upright storage position to an inverted discharging position, in the latter of which the funnel-shaped end 28 can be positioned directly above the funnel 26 on the hood 23. When thus positioned, the cap 29 of the inverted can or receptacle 27 is removed to allow material to flow into the container 17.

By placing the container 17 on the platform of a scale 41, the materials poured into it from the several cans or receptacles may be accurately proportioned, since the hood 23 is supported independently of the container 17 by its legs 42, as shown in FIGS. 3 and 6.

The stand 32 can be built to accommodate any number of cans or receptacles 27 and, to facilitate bringing any selected one of them into alignment with the assembled container 17 and hood 23, the legs or stanchions of the stand 32 can be equipped with wheels.

The carriers 30 are so proportioned that they and the cans or receptacles 27 secured thereon automatically assume and occupy an upright position, except when intentionally tilted forward to transfer material therefrom. That upright position is defined by engagement of the lower portion of the carriers with the bottom cross bar 34; and — for sake of balance — some of the carriers engage the cross bar 34 at one side thereof and others engage the opposite side of that cross bar, as shown in FIG. 3.

Figure 8:
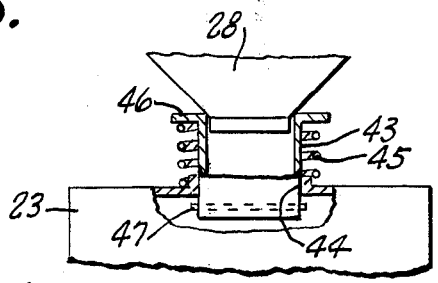
FIG. 8 is a fragmentary view of a part of the apparatus shown in FIG. 3, illustrating a modification thereof.

With the funnel 26 on the hood 23 fixed thereto, some space inevitably exists between it and the mouth of the can or receptacle in discharging position thereabove. While experience has shown that little or none of even the fluffiest material escapes through that space as it drops into the funnel, if desired that space can be closed in the manner shown in FIG. 8. In that case, the fixed funnel is replaced by a cylindrical sleeve 43 slidably mounted in a necked hole 44 in the top wall of the hood. A spring 45 surrounding the sleeve 43 and confined between a flange 46 at its upper end and the top wall of the hood, biases the sleeve upwardly and into engagement with the conical end portion 28 of an inverted can or receptacle in position above the hood.

The spring can be compressed sufficiently to enable the can or receptacle to be swung into position; and - to hold the parts assembled when the sleeve 32 is not held down by a can or receptacle — outward movement of the sleeve is limited by a suitable stop, which for illustration purposes is shown as a pin 47 inserted through holes in the sleeve 43. Obviously, during assembly of the parts, the pin 47 is inserted from the bottom of the hood while the sleeve is held depressed.

Although the procedure and method by which this invention achieves its objective of mixing different materials in the dry state — some or all of which may be finely pulverized — without creating an objectionably dusty environment, should be clear from the foregoing description, for convenience the following brief recapitulation may be helpful.

With the container 17 setting on the platform of the proportioning scale 41 and the hood 23 supported in position thereover by legs 42, the suction source (vacuum cleaner) 24 is turned on to maintain a subatmospheric condition inside the hood. Now, one after the other of the different materials is poured into the container 17 through the funnel-equipped hole 25 in the top of the hood, the amount of each being weighed on the scale 41.

When all of the materials needed to produce a particular product — as, for instance, a compound useful to stop leaks in automobile radiators — have been introduced into the container 17 and correctly proportioned by weighing the same as they enter the container, the suction source is turned off and the hood 23 lifted off the container. The filled container is then carefully moved to a position beneath the now downwardly facing mouth of the mixing drum, as shown by dotted lines in FIG. 1, and then lifted and inserted into the mouth of the drum to which it is secured by bolting the flanges 18 and 20 together. That done, the admixture of the materials is effected by operation of the mixing machine in the conventional manner, but since the attachment of the container to the mixing drum tightly seals the junction therebetween, none of the drum contents can escape even though some or all of them are finely pulverized.

Those skilled in the art will appreciate that the invention can be embodied in forms other than as herein disclosed for purposes of illustration.

The invention is defined by the following claims:

1. A method of mixing dry powdered material which comprises:

A. providing a mixing drum having a mouth;

B. providing an open-topped container having an upper portion of a size to fit into the mouth of the mixing drum;

C. placing a hood over the open top of said container;

D. through a hole in the top of said hood, pouring the materials to be mixed into said container;

E. as the materials are poured into the container, maintaining a subatmospheric pressure in the hood by connecting its interior with a source of suction;

F. when all of the materials to be mixed have been poured into the open-topped container, lifting the hood from its position over the open top of the container;

G. with the mouth of the mixing drum facing downward, inserting the upper open-topped portion of the container into the mixing drum; and H. securing the container to the mixing drum with the space between the sides of the container and the mouth of the mixing drum sealed, so that the container coacts with the mixing drum to form a closed chamber confining the materials to be mixed, whereby mixing of the materials can be effected without dispersion of powdered material into the atmosphere.

2. The method of claim 1, further characterized by: supporting the open-topped container by means of a scale while the materials are poured into it, to thereby weigh and proportion the different materials.

3. The method of claim 2, further characterized by: supporting the hood independently of the container, so that the weight of the hood does not affect the weighing of the materials as they are poured into the container.

4. The method of claim 3, further characterized by:

A. supplying the different materials in comparable sized and shaped receptacles with funnel-shaped discharge mouths capable of being closed and opened;

B. tiltably mounting said receptacles in an elevated upright position with the discharge mouths thereof closed;

C. aligning one of said receptacles with the assembled open-topped container and hood;

D. tilting said receptacle to face its funnel-shaped mouth downward and in line with the hole in the top of the hood;

E. opening the mouth of said receptacle and thereby allowing a weight measured quantity of the receptacle contents to flow down into said container;

F. closing the mouth of the receptacle and returning the receptacle to its upright position; and G. repeating the aforesaid steps with each of the receptacles.

5. The method of claim 4, further characterized by:

A. providing the hood with an upwardly biased sleeve that projects slidably up through the hole in the top of the hood;

B. depressing said sleeve preparatory to aligning the funnel-shaped mouth of said receptacle with the hole in the top of the hood; and C. after the mouth of said receptacle has been opened, releasing said upwardly biased sleeve so that the top of the sleeve abuts the funnel-shaped discharge mouth and forms a duct leading from the mouth of the receptacle to the interior of said hood.

6. A method of mixing dry powdered materials which comprises:

A. providing a mixing drum having an opening to receive materials to be mixed therein;

B. providing an open-topped material receiving container of a size complementary to the material receiving opening of said mixing drum;

C. placing a hood over the open top of said container;

D. through a filling opening in the top of said hood pouring the materials to be mixed into said container;

E. when all of the materials to be mixed have been poured into the open-topped container, lifting the hood from its position over the top of the container; and F. securing the loaded container to the mixing drum with the container closing the opening in the mixing drum so that the container coacts with the mixing drum to form a unitary closed chamber confining the materials to be mixed.

7. A method of mixing dry powdered materials which comprises:

A. providing a mixing drum having an opening to receive materials to be mixed therein;

B. providing an open-topped material receiving container of a size complementary to the material receiving opening of said mixing drum;

C. maintaining a zone of subatmospheric pressure directly above the open top of said material receiving container;

D. pouring the materials to be mixed through said zone of subatmospheric pressure and into said open topped container; and E. when all of the materials to be mixed have been poured into said container, securing the same to the mixing drum with the container closing the opening in the mixing drum so that the container coacts with the mixing drum to form a unitary closed chamber confining the materials to be mixed.

8. Apparatus for mixing dry powdered materials without creating a dusty environment, comprising:

A. a rotatable mixing drum having a mouth through which the drum is charged and discharged and a radially projecting flange encircling the mouth of the drum;

B. an open-topped container having imperforate bottom and side walls, the upper open-topped portion of the container having a cross sectional size and shape to telescope into the mouth of the mixing drum;

C. a radially projecting flange encircling the medial portion of the container side wall to engage the flange encircling the mouth of the mixing drum when the container is telescoped into the drum, said flanges having mating surfaces which fit one another in a dust-tight manner; and D. fastening means contacting only said flanges for detachably securing the flanges together, to thereby fix the container to the mixing drum with the open top of the container inside the mixing drum, so that the container and the mixing drum together form a closed chamber in which the materials can be mixed without creating a dusty environment.

* * * * *